United States Patent [19]

Carden

[11] Patent Number: 4,516,362

[45] Date of Patent: May 14, 1985

[54] AWNING STRINGER

[75] Inventor: Lloyd E. Carden, St. Petersburg, Fla.

[73] Assignee: Aluminum Metals, Inc., St. Petersburg, Fla.

[21] Appl. No.: 496,976

[22] Filed: May 23, 1983

[51] Int. Cl.[3] ..... E04F 10/08

[52] U.S. Cl. ..... 52/75

[58] Field of Search ..... 52/73, 74, 75, 76, 14, 52/15, 473, 762, 656

[56] References Cited

U.S. PATENT DOCUMENTS

| | | | |
|---|---|---|---|
| 2,814,079 | 11/1957 | Van Fleet | 52/74 |
| 2,848,765 | 8/1958 | Showalter | 52/74 |
| 2,902,730 | 9/1959 | Meagher | 52/74 |
| 3,015,135 | 1/1962 | Dean | 52/74 |
| 3,782,062 | 1/1974 | Woods | 52/75 |

*Primary Examiner*—John E. Murtagh

*Attorney, Agent, or Firm*—Ronald E. Smith

[57] ABSTRACT

An awning stringer. A pair of parallel beam members, each having a cross section similar to that of an I beam are interconnected by an orthogonally disposed link member having inwardly beveled opposite ends. The respective upper peripheral edges of the beam members are specifically configured to grip the individual slats that collectively form an awning, so that an awning having a downward curvature or bend at its distal free end is gripped when the lowermost portions of the beam members are made to converge with respect to one another, which convergence results in abutting engagement of the respective beam members and the respective beveled ends of the link member, and which convergence results in a corresponding divergence of the slat gripping upper peripheral edges of the beam members to grip the awning as desired.

4 Claims, 4 Drawing Figures

AWNING STRINGER

BACKGROUND OF THE INVENTION

1. Field of the Invention

This invention generally relates to awning structures, and more specifically relates to an improvement in awning stringers.

2. Description of the Prior Art

A commercial search firm was retained to conduct a search of United States patents prior to the filing of this disclosure. After a three-day search, it was reported that no relevant prior art exists in the field of this invention.

However, awning stringers are generally known. Conventional stringers are usually constructed by riveting a pair of channel members in back-to-back relation to one another. The lower portion of the conventional stringer is generally referred to as a "hat" section, and is employed to provide additional strength to the stringer.

It is important to note that the stringers of the prior art are not interconnected to one another in the context of the awning structures within which they are used, nor are they interconnected to the telescoping support arms employed to support the awning. Conventional stringers merely interconnect laterally adjacent ones of the individual awning slats that collectively form an awning, and conventional support arms are simply mounted to the awning itself so that no direct connection is established either between the individual stringers or between the stringers and the support arms. Accordingly, conventional awning structures lack substantial structural integrity.

There is a need for an awning stringer that performs its function in a superior manner relative to conventional stringers, that exhibits greater strength than conventional stringers, that can be constructed using less materials than conventional stringers, and that can grip the individual awning slats that collectively form an awning in a superior fashion, but the needed stringer does not appear in the prior art.

SUMMARY OF THE INVENTION

The longstanding but heretofore unfulfilled need for an improved awning stringer is now provided in the form of a stringer having the general configuration of an I beam. The flange portions of the I beam are parallel to one another, and sloped downwardly from the horizontal. The upper flange members are provided with upstanding sidewalls at their respective distal free ends so that a pair of elongate channels is formed on either side of the slat gripping portion of the stringer.

In use, two of the novel stringers are disposed in parallel alignment with one another, transverse to the longitudinally disposed awning slat members. A unique interconnecting member having inwardly beveled ends is employed to interconnect the stringers. The spacing between the upper and lower flange members on the novel stringer is sufficient to receive the associated beveled end of the interconnecting member, and the stringers are pivoted so that their respective lower portions converge with respect to one another and their upper portions diverge relative to one another attendant abutting engagement of the stringer members and said beveled ends. The lower flange portions of the stringers are joined by a tie arm member to maintain the stringers in their pivoted disposition.

In some installations, such as an integral suspended ceiling installation, for example, the novel stringers may have utility as individual, non-interconnected stringers. In such a case, no tie arm would be employed.

It is therefore seen to be a general object of this invention to provide an improved awning stringer.

A more specific, very important object is to provide an awning structure having stringer members interconnected to one another and interconnected to conventional awning support arms so that the entire inventive assembly forms a cohesive, structurally improved whole.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

DETAILED DESCRIPTION OF THE PREFERRED EMBODIMENT

Figure 1:
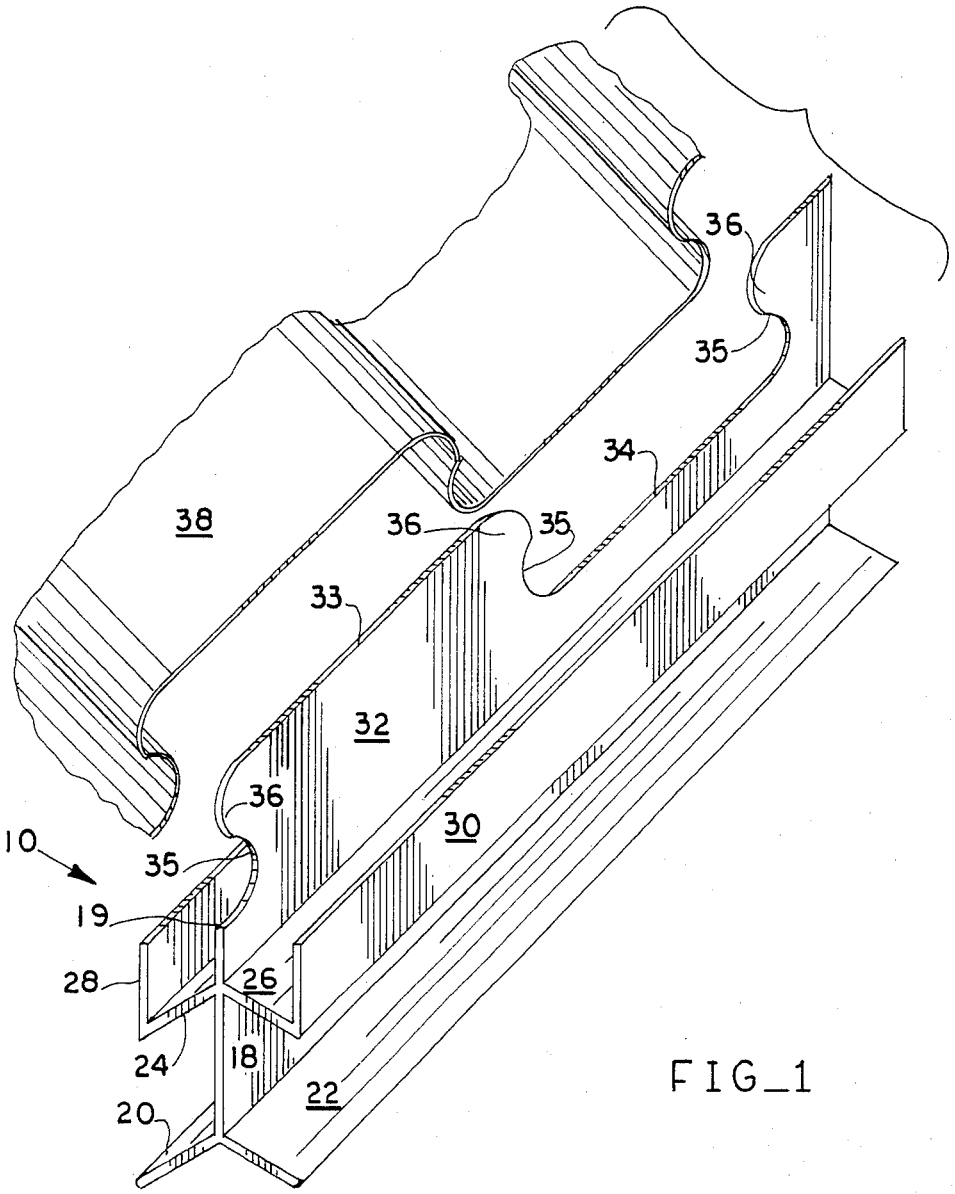
FIG. 1 is a perspective view of the preferred embodiment of the stringer portion of this invention.

Referring now to FIG. 1, it will there be seen that a first part of the inventive assembly is designated by the reference numeral 10 as a whole. The beam 10 is an elongate, rigid member known in the industry as a "stringer", although a conventional stringer is shown in FIG. 2.

Figure 2:
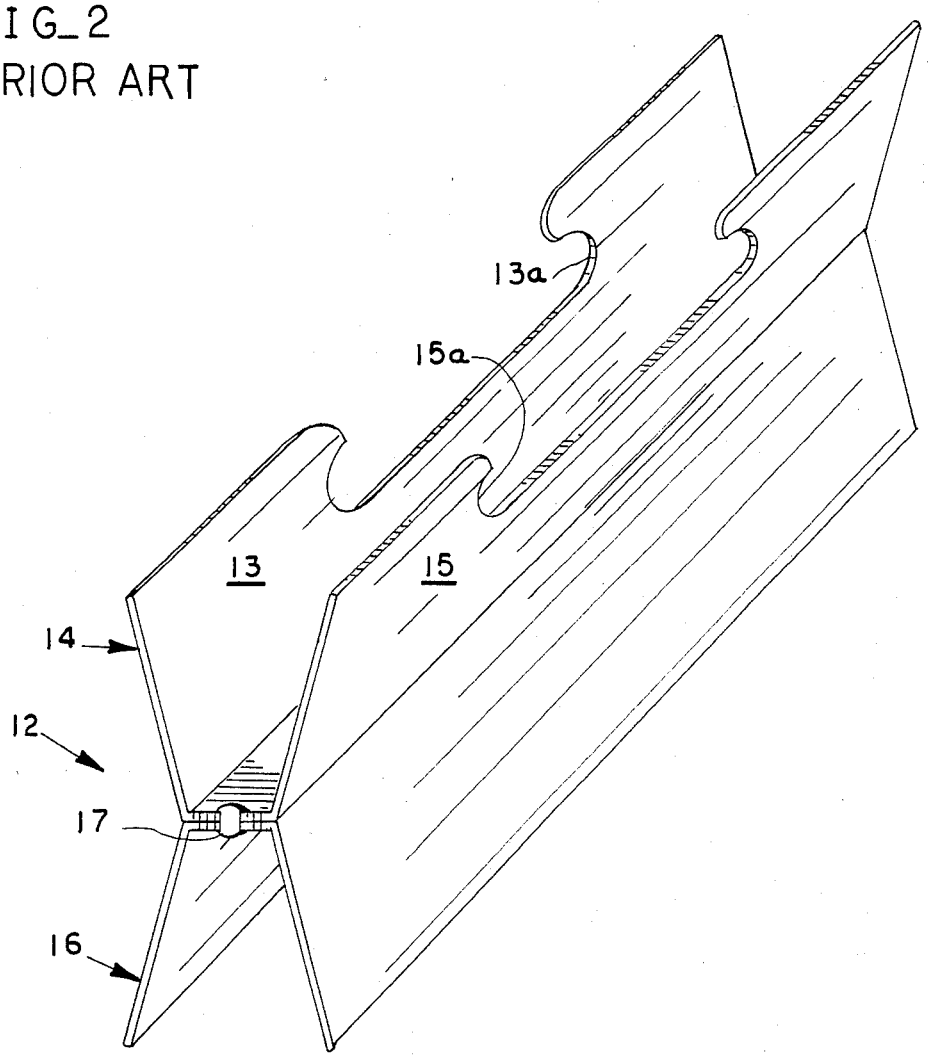
FIG 2 PRIOR ART
FIG. 2 is a perspective view of a conventional stringer.

The stringer 12 of FIG. 2 includes a pair of back-to-back channel defining members 14 and 16 that are riveted together as at 17. The respective walls 13, 15 of the upper member 14 are provided with cutout portions **13*a*, 15*a* so that each wall 13, 15 defines a succession of awning slat gripping means. The lower member 16 is known in the trade as a "hat" section and is provided only when additional strength is required. However, additional strength is often required, and the provision of "hat" section 16 adds a significant amount to the cost of the stringer 12**.

Figure 3:
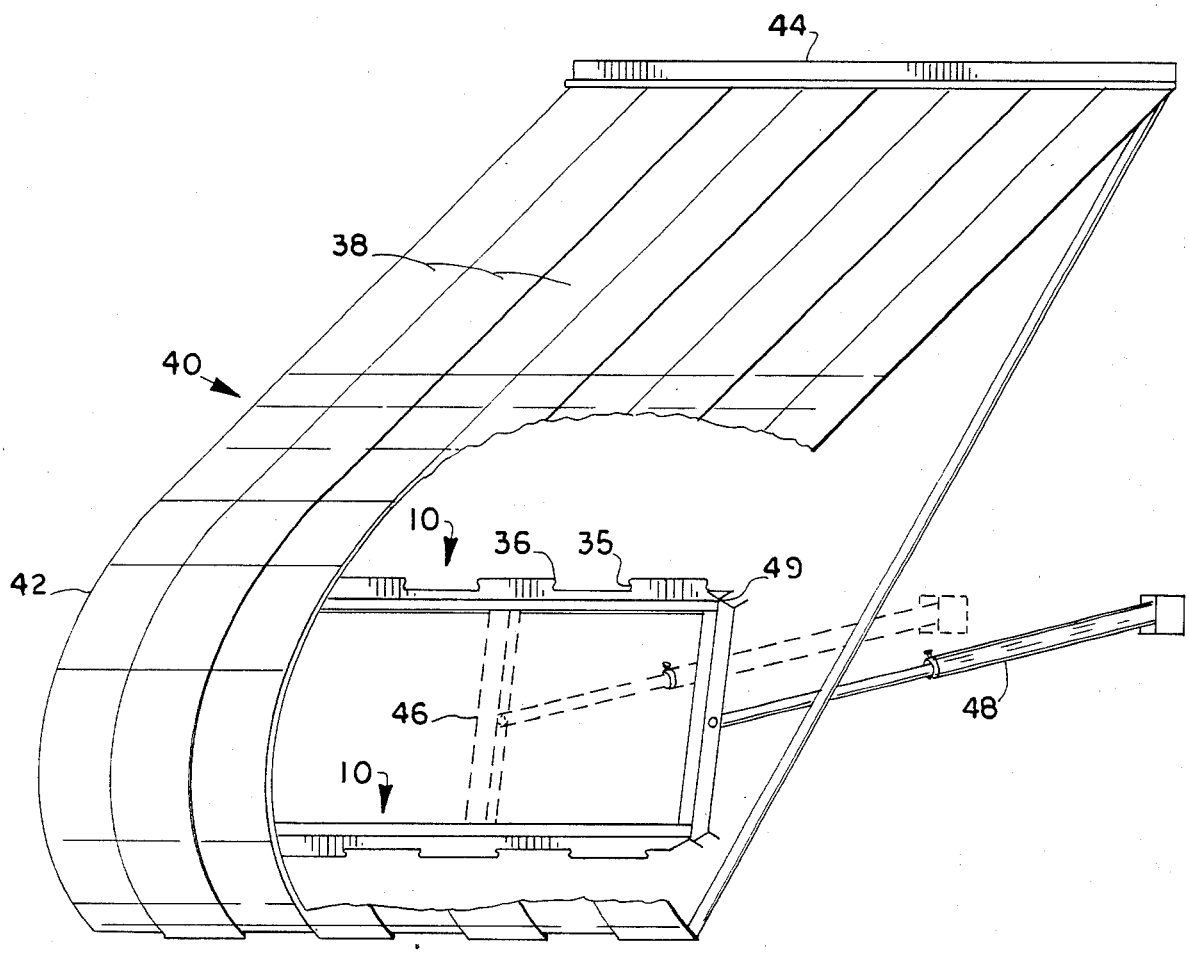
FIG. 3 is a partially cutaway, perspective view of an awning showing how the novel stringer members are disposed relative to one another and interconnected by the novel member having beveled ends.
Figure 4:
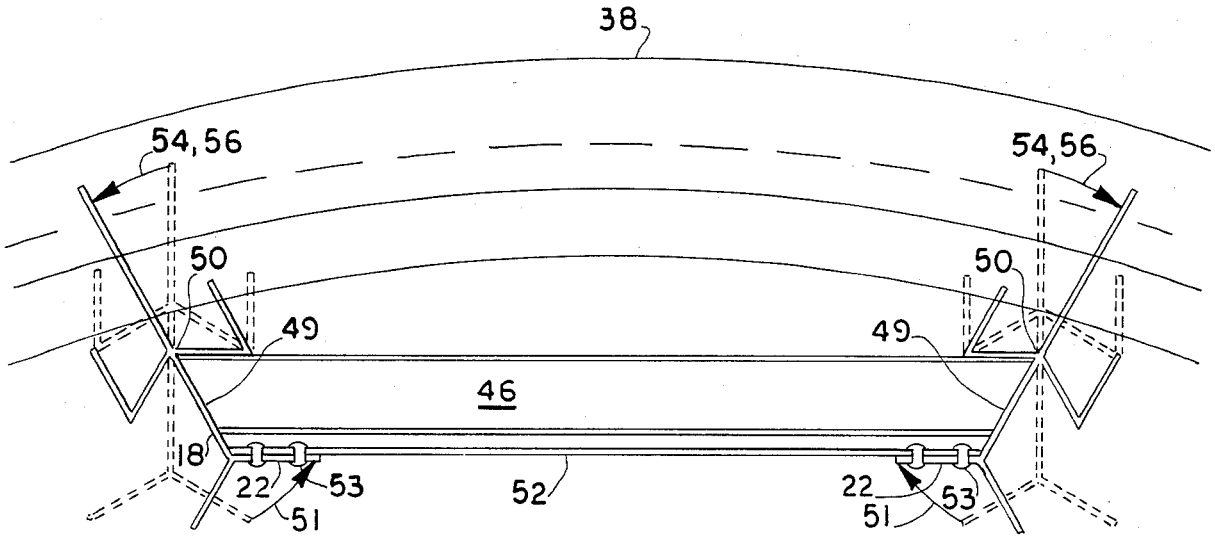
FIG. 4 is a cross sectional view taken along line 4—4 of FIG. 3.

The novel stringer 10, dipicted in FIGS. 1, 3, and 4, uses less material than the conventional stringer 12, and its "hat" section is provided as an integral part thereof. Thus, the novel stringer 10 has utility in all applications, and its use in additional strength applications does not entail the addition of a separate "hat" section as in conventional stringers.

Stringer 10 also exhibits strength equal to or greater than that exhibited by conventional stringers.

As is clearly shown in FIG. 1, the novel stringer 10 includes an elongate, upstanding, flat body portion 18. A first pair of flange members 20, 22 are integrally formed with the lowermost extremity of body portion 18 and are disposed at a common downward angular disposition from the horizontal. A second pair of flange members 24, 26 is spaced vertically upward to the first pair and disposed in parallelism therewith. Clearly, the first and second pairs of flange members and the body portion 18 collectively form a modified I beam configuration, the strength properties of which are well known.

It should be noted that the second pair of flange members 24, 26 are spaced vertically downwardly of the uppermost peripheral edge 19 of the body portion 18. Upstanding sidewalls 28, 30 are integrally formed with the respective distal peripheral edges of the flange members 24, 26 and such sidewalls 28, 30 have a height substantially equal to the amount of spacing between said uppermost peripheral edge 19 of body portion 18 and the proximal ends of such flanges 24, 26 and the vertical distance traversed by the aforementioned downward slope of such flanges.

Individual awning slats are gripped by the novel stringer 10 by the flat plate member 32 that is integrally formed with and disposed coplanar to body portion 18. Plate 32 is provided with a plurality of equidistantly spaced cutout portions, collectively designated 34. Each cutout portion 34 is in open communication with the upper peripheral margin 33 of plate 32 and includes opposed undercut portions 35 to define overhang portions 36.

The alternating sequence of cutout portions 34 and the remaining non-cutout portions of plate 32 enables the interlocking of laterally adjacent ones of awning slats 38 as is well known, such interlocking being diagrammatically depicted in FIG. 1.

Referring now to FIG. 3, it will there be seen that an awning 40 composed of laterally interlocking individual slats 38 has an arcuate bend 42, or curvature formed therein at its distal free end. The proximal end of the awning 40 is fixedly secured in conventional fashion as at 44 to a support surface such as a wall, not shown.

It is critical to observe that a pair of the inventive stringers 10, 10 are interconnected to one another in the inventive system, which interconnection was heretofore unknown in the art. The stringers 10, 10 are disposed transversely to the longitudinally aligned slats 38 and are interconnected by a longitudinally aligned interconnecting members 46. Conventional telescoping support arms 48 are pivotally mounted mid-length of the novel interconnecting member 46 as shown and it should be understood that as many support arms 48 and members 46 may be provided as conditions require.

It is worthy to recall that the support arms of the prior art are simply affixed to the awning itself at a point remote from the stringers. Usually a vertical side panel is selected as the point where the distal end of a support arm is secured to the awning. This arrangement provides an awning having little structural strength but the arrangement now being disclosed provides an awning having remarkably improved structural characteristics due to the interconnection established between the stringers and the support arms through the interconnecting members.

FIG. 4 shows that the interconnecting member 46 has an inwardly sloping bevel 49 formed in its opposite ends. When the inventive stringers have been properly installed, the respective body portions 18 thereof will abut their associated bevel edges 49 as is clearly shown in FIG. 4. The stringers 10 are initially placed in their respective upright positions shown in FIG. 4 in phantom lines, with the slats 18 gripped by the plate 32 as aforesaid. The respective stringers are then rotated about pivot points 50, 50 in the direction indicated by directional arrows 51 until the respective body portions 18 abut the beveled ends 49 as aforementioned. An elongate tie arm 52 is then employed to interconnect the opposed flange members 20, 22 to thereby maintain the stringers 10, 10 in their rotated positions. Rivet means 53 may be employed to accomplish the desired interconnection, although any suitable fastening means may be employed. The pivotal mount causes the upper portions of the respective stringer assemblies to diverge, as indicated by the directional arrows 54. This action serves to securely clamp the slats 18 into place.

The bevels 49 are formed at about a thirty (30) degree angle, so the respective angles indicated by the numeral 56 are the same. The angle of bevel may be changed, and the invention is not limited to any particular angle of bevel.

It will thus be seen that the objects set forth above, and those made apparent by the preceding description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, that which is claimed is:

1. An awning stringer, comprising, in combination,
a first rigid, elongate beam member,
a second rigid, elongate beam member,
an awning member having a top side and a bottom side,
said awning member formed collectively by a plurality of longitudinally disposed, laterally interlocking slat members,
said awning member having a proximal end fixedly secured to a support surface and having a distal free end longitudinally spaced therefrom configured to have an arcuate bend or non-arcuate, angled bend formed therein,
said first and second beam members disposed transversely to said slat members in parallel, longitudinally spaced relation to one another, and positioned within said arcuate or non-arcuate bend on the bottom side of said awning member,
said first and second beam members configured to engage individual ones of said slat members,
a longitudinally disposed interconnecting member disposed in interconnecting relation to said first and second beam members,
said interconnecting member having an inwardly sloped bevel surface formed in each of its opposite ends,
said first and second beam members configured to abut associated ones of said beveled surfaces so that the respective upper portions of said beam members diverge relative to one another and their respective lower portions converge relative to one another,
and means for rigidly interconnecting said lower portions of said beam members to maintain said beam members in their abutting relation to said interconnecting member.

2. The stringer of claim 1, wherein each of said first and second beam members comprises, in combination, an elongate, upstanding, flat plate member defining the body portion of said stringer, a first pair of elongate, flat plate members integrally formed with said body portion and projecting from the lower extremity thereof at a common downwardly extending predetermined angular disposition thereto in symmetrical relation to one another, a second pair of elongate, flat plate members integrally formed with said body portion and positioned in parallelism to said first pair of flat plate members, said second pair of flat plate members being vertically spaced upwardly of said first pair of flat plate members and being vertically spaced downwardly of the upper extremity of said body portion, and a pair of elongate, upstanding wall members integrally formed with said second pair of flat plate members and projecting from the respective distal free ends thereof.

3. The stringer of claim 2, wherein each of said first and second beam members comprises, in combination, a flat, elongate, upstanding awning gripping means integrally formed with said body portion, projecting from the upper edge thereof and lying coplanar therewith, said gripping means having a plurality of equidistantly and longitudinally spaced openings formed therein extending from the uppermost peripheral edge of said gripping means to the lowermost peripheral edge thereof, each of said openings defining an undercut portion at their respective opposite ends to thereby define a plurality of equidistantly and longitudinally spaced non-cutout portions having an overhang portion at their respective opposite ends, said non-cutout portions and said undercut portions cooperating to provide means for gripping successively laterally spaced edges of said slat members.

4. The stringer of claim 3, further comprising, a tie arm means for interconnecting opposed ones of said first pair of elongate flat plate members to maintain a pair of longitudinally spaced stringer members in their pivoted position with respect to said interconnecting member having beveled ends to thereby maintain said awning slats in a clamped engagement relative to said stringer members.

* * * * *